United States Patent [19]

Karlsson

[11] Patent Number: 4,578,881

[45] Date of Patent: Apr. 1, 1986

[54] DRIER FOR KNITTED GARMENTS

[76] Inventor: John I. Karlsson, 4280 Motor Ave., Culver City, Calif. 90230

[21] Appl. No.: 673,505

[22] Filed: Nov. 20, 1984

[51] Int. Cl.[4] ..... F26B 9/10

[52] U.S. Cl. ..... 34/151; 34/211; 34/233; 34/238

[58] Field of Search ..... 34/232, 233, 231, 54, 34/210, 211, 237, 238, 151

[56] References Cited

U.S. PATENT DOCUMENTS

| | | | |
|---|---|---|---|
| 1,804,107 | 5/1931 | Mueller | 34/231 |
| 1,895,323 | 1/1933 | Hauf | 34/238 |
| 3,962,799 | 6/1976 | Lapointe et al. | 34/54 |

FOREIGN PATENT DOCUMENTS

| | | | |
|---|---|---|---|
| 2264512 | 10/1975 | France | 34/233 |
| 108960 | 8/1979 | Japan | 34/233 |

*Primary Examiner*—Larry I. Schwartz

*Attorney, Agent, or Firm*—Bruce L. Birchard

[57] ABSTRACT

One or more mesh-topped, extendable trays removably coupled to a motor-driven fan for causing forced air, normally at ambient temperature, to pass thru the mesh top or tops and thru one or more knitted or crocheted garments lying thereon, the flow of air into each tray being adjustable and an air diverter preferably being provided to assure equal distribution of forced air within each tray, the combination producing drying of the garment rapidly but without shrinking or other distortion.

3 Claims, 5 Drawing Figures

DRIER FOR KNITTED GARMENTS

FIELD OF THE INVENTION

This invention relates to driers for knitted or crocheted garments, or the like.

BACKGROUND OF THE INVENTION

Knitted or crocheted garments, particularly of wool, have conventionally, in the past, been dried by placing them over towels, or the like, and the process takes extended periods of time because of the absorbent nature of the yarn and the fact that the garment is dried one side at a time.

A search of the records at the United States Patent and Trademark Office revealed the following patents which are related to, but do not anticipate my invention.

U.S. Pat. No. 2,521,100 (Sublette) entitled "Garment Drier" is directed to a passive garment drier which is made up of two sections hinged to each other and each containing a plurality of finely spaced apertures therethrough to permit the passage of air. The garment to be dried is placed in the unfolded rack and then it is folded into a closed position and hung. The most that this patent contributed to the prior art is the recognition of the fact that the drying time for knitted or crocheted garments is very long and the practice of the past was very inconvenient. However, it does not recognize, among other things, the desirability of using forced air to accelerate the drying process. Thus, the device still does not reduce the drying time for a knitted garment to a reasonable time period.

U.S. Pat. No. 4,192,081 (Erickson) is directed to a food dehydrating machine in which air is heated and passed over the surface of food to cause it to become dehydrated. There is no suggestion of the use of this approach for the drying of knitted garments and, because the patent discloses the heating of the air that passes over the food to be dehydrated, it would not be usable in drying a knitted garment for, as is well known, if such a garment is heated during the drying process it will shrink. Further, there is no indication of any ability to change the size of the drying system to accommodate different sizes of garments, for example. Once again, the air passes over, not through, the product being dried. The disclosure of this patent is basically confined, in its use, to the food dehydrating field.

U.S. Pat. No. 3,256,617 (Konstandt) is directed to apparatus for drying laundry in a hanging position by means of air passed over the laundry, not through it. As is well known, knitted garments, such as wet sweaters or the like, cannot be hung during drying because they will stretch; therefore, the device of Konstandt would be worthless as far as the drying of knitted garments, which is the objective of my invention, is concerned.

U.S. Pat. No. 2,197,178 (Gates) is directed to dish drying apparatus in which heated air is passed over the surface of dishes standing in a rack. This device would obviously not be useful in any way in connection with the drying of knitted garments.

U.S. Pat. No. 2,470,646 (Richardson) is directed to a clothes dryer in which heated air is passed over the surface of garments hung in the clothes dryer. There is no suggestion of passing the air through the garments and there is no suggestion of being able to adjust the dimensions of the dryer to accommodate various-sized garments.

U.S. Pat. No. 2,856,700 (Wales) is directed to a laundry dryer that is convertible into a coiffure dryer. Air, in the laundry drying application, passes air over the surface of laundry hanging over tubular clothes racks 9, 9' and 10, 10'. As is well known, such a structure could not be used for drying sweaters because they would stretch and otherwise distort.

U.S. Pat. No. 3,939,574 (Garot) is directed to a linen dryer in which the linen is suspended from bars and air is passed over the linens to dry them. Such a structure is not usable in connection with knitted garments because they would stretch in the hanging process. No provision is made for garments of varying lengths and the patent covers subject matter which is not anticipatory of my invention.

Therefore, it is an object of this invention to overcome the various difficulties and disadvantages of the prior art devices, as set forth hereinbefore.

It is a further object of this invention to provide a garment dryer that is particularly adapted for the drying of knitted or crocheted garments and which is capable of adjustably receiving garments of different sizes to permit their drying without distortion of the shape of the garments.

SUMMARY OF THE INVENTION

A three-dimensional tray of extendable length and having a mesh top and solid sides is removably coupled to a motor driven fan, preferably of the squirrel-cage variety, for causing forced air, normally at ambient temperature, to pass through the tray and upwardly through the mesh top of the tray to pass through the knitted garment lying on the tray, the length of the tray having been adjusted to accommodate the particular size of the garment being dried. The forced air from the electrically-driven squirrel-cage fan passes through a diffuser or a diverter to assure that air flows evenly to all portions of the mesh-topped tray and thus, evenly through all portions of the garment being dried. Several such trays may be stacked and coupled to a single forced air source, the proportion of air coming from that source to the respective ones of the trays being adjustable by means of a damper which is selectively movable over varying portions of the mouth of each of the trays in the stack. The trays have collapsible legs to permit their storage in minimum space and are easily coupled to and decoupled from the forced-air source. Each of the trays in the stack has the air flowing into it dispersed uniformly throughout the volume of the tray by means of diffusers or diverters so as to assure that the garment which is being dried is dried evenly and distortion of the garment will not occur through shrinking or stretching.

BRIEF DESCRIPTION OF THE DRAWINGS

My invention may be best understood by studying the description which follows in conjunction with the drawings accompanying this Specification, in which.

DETAILED DESCRIPTION OF THE PREFERRED EMBODIMENT

Figure 1:
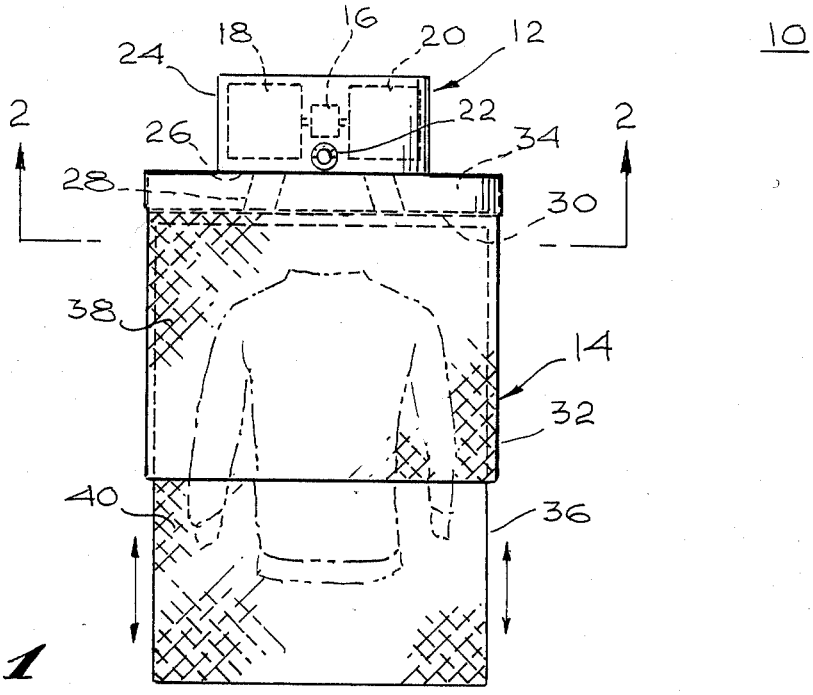
FIG. 1 is a plan view of one embodiment of an improved garment drier, according to my invention.

In FIG. 1 garment drier 10 includes a motor-fan section 12 and a tray section 14 removably coupled thereto. Motor-fan section 12 includes an electrical motor 16 which is coupled to a pair of squirrel-cage fans 18 and 20. The motor is controlled as to speed and operation, i.e., on-off status, by means of control knob 22 which is coupled through appropriate electrical circuits, not shown, so as to control the speed of motor 16. The operation of the squirrel-cage fans of the type utilized in connection with items 18 and 20 is well known and need not be discussed further here. The combination of motor 16 and fan members 18 and 20 is enclosed by a cover 24, as may be seen more clearly in FIG. 2. Forced air is exhausted through exit 26 and the direction of the forced air may be modified by means of diffusers 28. Thus, air exists at output mouth 30 with relatively even pressure across the face of that mouth.

Tray section 14 has a first section 32 which is coupled to motor-fan section 12 by the overlapping of end 34 of first section 32 over output mouth 30. First tray section 14 has air at substantially equal pressure across its input face introduced into the internal volume of tray section 32. Tray section 14 includes a second section 36 which telescopes within first section 32 and is slidable into and out of first section 32 so as to provide a tray section 14 of extendable or retractable length. The upper surface 38 of first section 32 and the upper surface 40 of second section 36 have a stretched air-permeable material to permit easy flow of air therethrough. However, it is stretched at its edges so as to provide a level surface upon which garments to be dried may be laid. Once again, it should be noted that second section 36 telescopes within first section 32 to permit the accommodation of garments of differing sizes.

Figure 2:
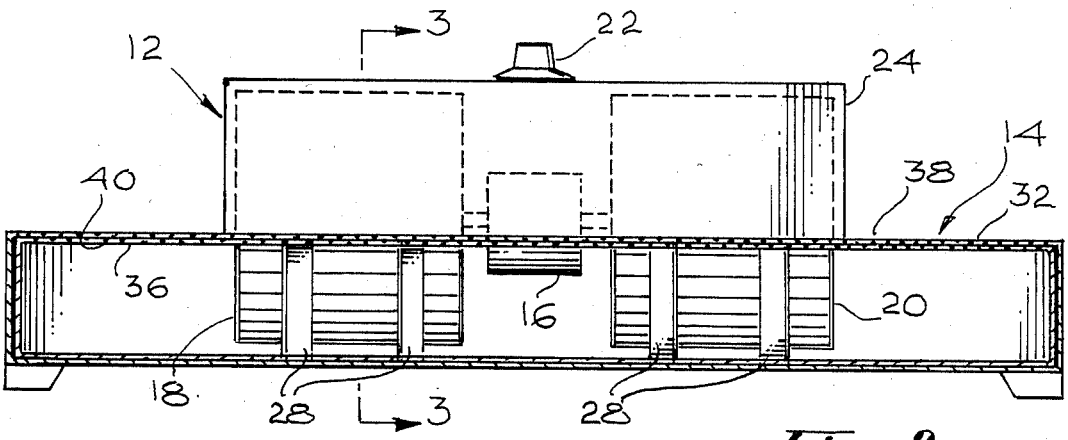
FIG. 2 is a cross-sectional view taken along the line 2—2 in FIG. 1.

A view into the motor-fan section 12 is set forth in FIG. 2. In FIG. 2 motor 16, which is connected to a source of electrical power, not shown, is controlled in its operation by speed control 22 to adjust the pressure within drier tray section 14 so that a garment which has been laid upon the porous upper surface 40 will have the maximum amount of air passing through it without causing it to move off the surface 40. Motor 16 drives, for example, a pair of squirrel-cage fans 18 and 20 and the forced air produced by fans 18 and 20 emerges from mouth 34 of motor-fan section 12 with its flow adjusted by diffusers 28 to assure that the volume of the tray section 14 is evenly filled with air under pressure so that any garment lying on the top of tray section 14 is appropriately dried.

Figure 3:
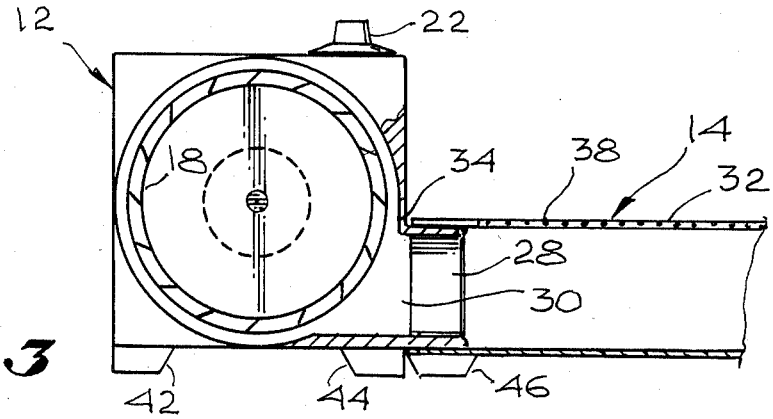
FIG. 3 is a cross-sectional view taken along the line 3—3 in FIG. 2.

In FIG. 3, a cross-section taken along the line 3—3 in FIG. 2 is set forth, in part. Once again squirrel-cage fan 18 is shown in cross-section as are diffusers 28 which produce even distribution of forced air in tray section 14. The speed of fan 18 and its accompanying fan 20, not shown, is controlled by means of speed control 22. Tray section 14 overlaps mouth portion 34 of motor-fan portion 12 to form a pneumatic coupling between motor-fan section 12 and tray section 14. Appropriate legs 42 and 44 are provided on motor-fan section 12 and, similarly, legs 46 are provided on tray section 14 to insure proper coupling between tray section 14 and motor-fan section 12.

Figure 4:
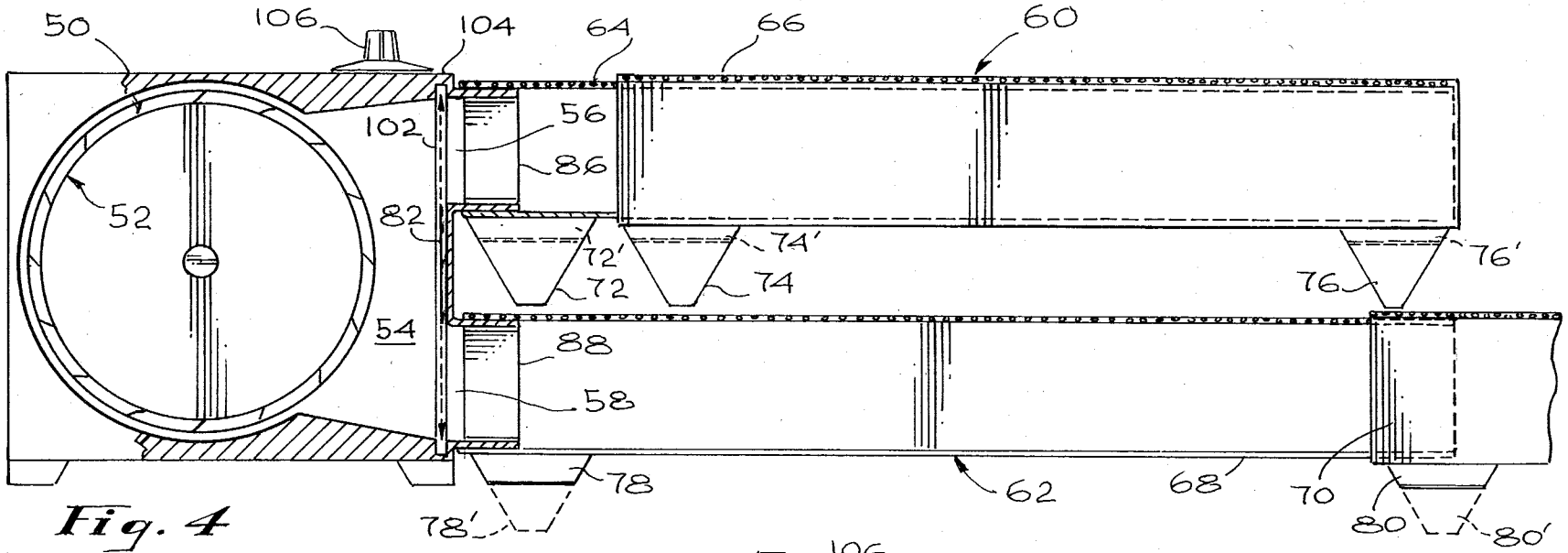
FIG. 4 is an elevational view, partially cross-sectioned, showing a second embodiment of my invention; and, FIG. 5 is an end view of the embodiment of my invention set forth in FIG. 4.

In some cases, it may be desirable to dry several sweaters, or other knitted garments, at the same time. The drier of FIGS. 4 and 5 accomplishes that end. Once again, there is a motor-fan section 50 utilizing one or more squirrel-cage fan members 52 to produce compressed air at throat 54 of motor-fan section 52. Throat 54 terminates in a pair of exhaust ports 56 and 58 which are sized and positioned to cooperate with a pair of extendable drying trays 60 and 62, each of which is made up of a pair of telescoping portions 64, 66, in the case of tray section 60, and 68, 70, in the case of tray section 62. Each of the tray sections 60 and 62 has appropriate legs. For example, tray section 60 has legs 72, 74 and 76, with corresponding legs existing on the opposite edge of the tray section 60. Tray section 62 has legs 78 and 80, which are shown in the folded mode since tray section 62 is the bottom section in the stacked drying trays including tray section 60 and tray section 62. Each of the legs in both tray sections can be folded into the position shown in FIG. 4 for lower section 62. The folded mode has been designated with the same number, only primed, insofar as upper tray 60 is concerned, and the same number is used in the extended mode of each leg for lower tray section 62 only the number is primed.

It may be desirable to have different air flow into the upper and lower tray sections 60 and 62 respectively. To effect that end, damper 82 is provided. Damper 82 may be slid vertically to cover selected portions of exhaust ports 56 and 58, or to cover neither of those exhaust ports, in which case the full forced air volume flows equally into the upper and lower tray sections 60 and 62, respectively.

Figure 5:
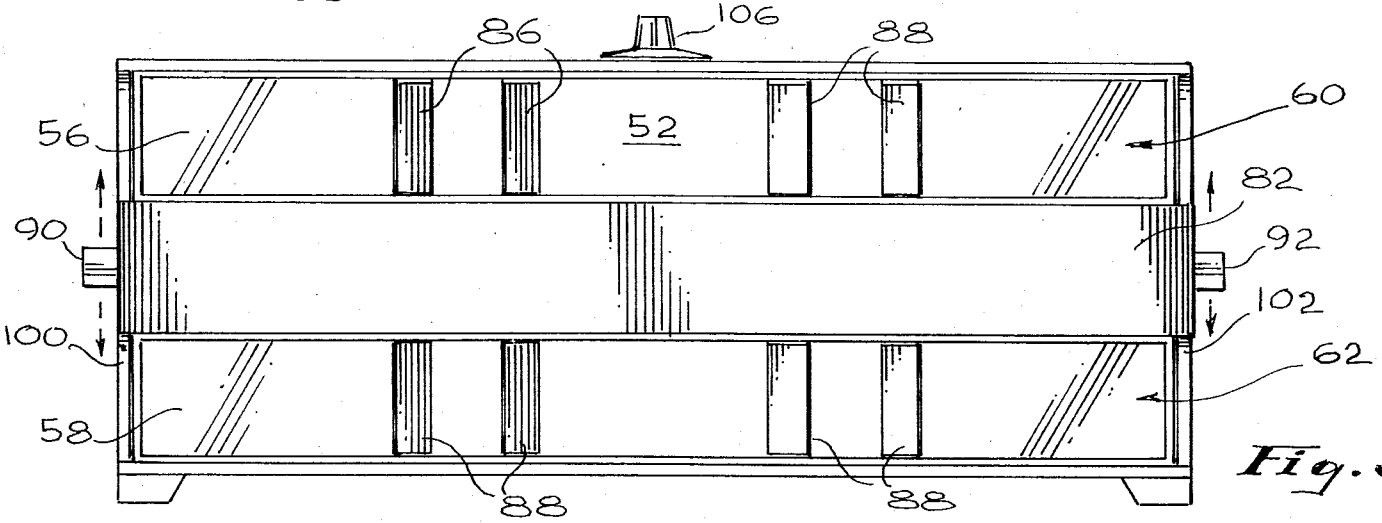

In FIG. 5, the view looking into motor-fan section 52 with the tray sections 60 and 62 removed, is presented. Diffuser plates 86 in upper tray section 60 are angularly positionable to assure that forced air from motor-fan section 52 is distributed evenly throughout the volume of upper tray section 60. Similarly diffuser plates 88 in lower tray section 62 are adjustable angularly to assure that forced air from motor-fan section 52 is distributed, as desired, in and throughout the volume of lower tray 62 so as to assure the desired drying of the knitted or crocheted garments. The positioning of diffuser plates 86 and 88 is apparent in FIG. 5. Further, it can be seen that damper 82 is vertically adjustable by means of knobs 90 and 92 to effect the desired proportioning of forced air flowing out of exhaust ports 56 and 62, respectively. Damper 82 slides in a pair of slots one in each end 100 and 102 in output region 104 of motor-fan section 52. Control knob 106 is provided to control the speed of the motor in motor-fan section 52. As has been indicated, diffusion plates 86 and 88 are angularly adjustable to divert the forced air in the desired direction.

While a particular embodiment of this invention has been shown and described, it will be apparent to those skilled in the art that variations and modifications may be made therein without departing from the spirit and scope of this invention. It is the purpose of the appended claims to cover all such variations and modifications.

I claim:

1. A drier for knitted or crocheted garments, including:

a motor-fan section having at-least-one forced-air output mouth for forced air at ambient temperature;

at-least-one tray section pneumatically and mechanically coupled to said at-least-one forced-air output mouth for the flow of air at ambient temperature from said motor-fan section to said at-least-one tray section;

said at-least-one tray section each having a pair of telescoping tray members pneumatically and mechanically intercoupled, each of said tray members having an air-permeable upper surface, solid side and bottom sections, one solid end section and one open end, such open end being intercoupled pneumatically with said at-least-one forced-air output mouth;

adjustable damper means supported in said motor fan section in the line of flow of air in said motor-fan section to said at-least-one forced-air output mouth;

said at-least-one output mouth having angularly-adjustable diffuser plates mounted therein for selectively directing forced-air into the accompanying tray sections; and, said at-least-one tray section having foldable legs thereunder.

2. A drier for knitted or crocheted garments, including:

a motor-fan section having at-least-two output mouths for forced air at ambient temperature;

tray sections pneumatically and mechanically coupled to respective ones of said at-least-two output mouths for the flow of air at ambient temperature from said motor-fan section to each of said tray sections;

each of said at-least-two tray sections having a pair of telescoping tray members pneumatically and mechanically intercoupled, each of said tray members having an air-permeable upper surface, solid side and bottom sections, one solid end section and one open end, such open end being intercoupled pneumatically with said at-least-two output mouths;

adjustable damper means supported in said motor-fan section in the line of flow of air in said motor-fan section to each of said at-least-two output mouths;

each of said at-least-two tray sections having foldable legs thereunder with a first height when extended and a second height when folded;

said at-least-two output mouths being aligned vertically with respect to each other and being spaced vertically from each other a distance substantially equal to said first height; and, the lower of said at-least-two forced-air outlet mouths being spaced vertically from the lowermost surface of said motor-fan section by a distance substantially equal to said second height, whereby with its legs folded the lower of said at-least-two tray sections is aligned with the lower of said at-least-two output mouths.

3. Apparatus according to claim 2 in which said at-least-two output mouths each has angularly-adjustable diffuser plates mounted therein for selectively directing forced air at ambient temperature into the respective accompanying tray sections.

* * * * *